US011326482B2

(12) United States Patent
Shelby

(10) Patent No.: US 11,326,482 B2
(45) Date of Patent: May 10, 2022

(54) METHOD AND SYSTEM FOR A CONTINUOUSLY VARIABLE VALVE LIFT SYSTEM

(71) Applicant: Ford Global Technologies, LLC, Dearborn, MI (US)

(72) Inventor: Michael Shelby, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 12 days.

(21) Appl. No.: 16/673,837

(22) Filed: Nov. 4, 2019

(65) Prior Publication Data

US 2020/0149437 A1 May 14, 2020

Related U.S. Application Data

(60) Provisional application No. 62/767,295, filed on Nov. 14, 2018.

(51) Int. Cl.

| | |
|---|---|
| ***F01L 1/34*** | (2006.01) |
| ***F01L 1/26*** | (2006.01) |
| ***F02B 75/20*** | (2006.01) |
| ***F01L 1/344*** | (2006.01) |
| *F02B 75/18* | (2006.01) |

(52) U.S. Cl.

CPC ..... *F01L 1/267* (2013.01); *F01L 1/3442* (2013.01); *F02B 75/20* (2013.01); *F01L 2001/3443* (2013.01); *F01L 2001/34446* (2013.01); *F01L 2305/02* (2020.05); *F02B 2075/1816* (2013.01)

(58) Field of Classification Search

CPC ..... F01L 1/267; F01L 1/3442; F01L 1/344; F01L 2001/3443; F01L 2001/34446; F01L 2001/34433; F01L 2305/02; F01L 9/025; F01L 9/02; F01L 9/00; F02B 75/20; F02B 2075/1816

USPC ..... 123/90.16, 90.15, 90.17

See application file for complete search history.

(56) References Cited

U.S. PATENT DOCUMENTS

| | | | | |
|---|---|---|---|---|
| 5,839,400 A * | 11/1998 | Vattaneo | F01L 1/26 | 123/90.16 |
| 6,883,492 B2 | 4/2005 | Vanderpoel et al. | | |
| 8,863,706 B2 * | 10/2014 | Ohsawa | F16K 11/07 | 123/90.12 |
| 2004/0103867 A1 * | 6/2004 | Hayase | F02F 1/4214 | 123/90.11 |
| 2006/0107914 A1 * | 5/2006 | Dingle | F01L 9/11 | 123/90.12 |
| 2017/0183989 A1 * | 6/2017 | Wigsten | F01L 9/11 | |

FOREIGN PATENT DOCUMENTS

| | | |
|---|---|---|
| CA | 2842854 A1 | 2/2013 |
| CN | 103726896 A | 4/2014 |

* cited by examiner

*Primary Examiner* — Zelalem Eshete
(74) *Attorney, Agent, or Firm* — Geoffrey Brumbaugh; McCoy Russell LLP

(57) ABSTRACT

Methods and systems are provided for a valve system for actuating two cylinder valves in an engine. In one example, the valve system may include a single pump and a solenoid valve capable of non-concurrently actuating the two cylinder valves coupled to separate cylinders.

16 Claims, 7 Drawing Sheets

METHOD AND SYSTEM FOR A CONTINUOUSLY VARIABLE VALVE LIFT SYSTEM

CROSS REFERENCE TO RELATED APPLICATIONS

The present application claims priority to U.S. Provisional Application No. 62/767,295, entitled "METHOD AND SYSTEM FOR A CONTINUING VARIABLE VALVE LIFT SYSTEM", and filed on Nov. 14, 2018. The entire contents of the above-listed application are hereby incorporated by reference for all purposes.

FIELD

The present description relates generally to methods and systems for a continuously variable valve lift (cVVL) system.

BACKGROUND/SUMMARY

A cylinder in an internal combustion engine is provided with an intake valve for supplying an air-fuel mixture to the combustion chamber and an exhaust valve for expelling burned gas from the combustion chamber. The intake and exhaust valves open and close the combustion chamber by a valve lift apparatus connected to a crankshaft. Based on engine operating conditions, valve lift for the intake valve and the exhaust valve of each cylinder may be adjusted to regulate an amount of a gas that is being introduced or exhausted.

Various approaches are provided for a continuous variable valve lift (cVVL) system where valve lift may be adjusted based on engine operating conditions. In one example approach, as shown in U.S. Pat. No. 6,883,492, Vanderpoel shows a variable valve actuation system including a master piston hydraulically linked to a slave piston, and a dedicated cam operatively connected to the master piston. The slave piston is adapted to actuate one or more valves coupled to the same cylinder. In the cVVL system, valves coupled to each cylinder may be connected to a distinct solenoid, a pump, and a pressure accumulator.

However, the inventors herein have recognized potential disadvantages with the above approach. As one example, connecting valves coupled to each cylinder to a distinct solenoid, a pump, and a pressure accumulator may increase cost of production. Also, a plurality of components coupled to the valves of each cylinder may take up space in the engine, thereby giving rise to packaging concerns.

The inventors herein have recognized that the issues described above may be addressed by a system for an engine comprising: a valve system including a pump and a solenoid valve for non-concurrent actuation of two cylinder valves coupled to two separate cylinders. In this way, by coupling two valves of two different cylinders to a single pump and solenoid, component cost may be reduced and packaging efficiency may be improved.

In one example, a single solenoid, a pump, and a pressure accumulator may be coupled to two separate valves of two separate cylinders in an 1-4 (in line four cylinder) engine. A four port, three way solenoid may be used for coupling the two valves of alternate cylinders to the single pump and pressure accumulator. In another embodiment, two solenoids may be used to couple the pressure accumulator to the two valves, the second solenoid used as a switch to select a valve that is to be actuated. In an 1-4 engine, a first cylinder and a fourth cylinder may have a same intake valve and exhaust valve timing while a second cylinder and a third cylinder may have a same intake valve and exhaust valve timing. Therefore, the intake or exhaust valves of the first cylinder and the fourth cylinder may be coupled via a first valve system while the intake or exhaust valves of the second cylinder and the third cylinder may be coupled via a second valve system. In another system, a cam drive and a camshaft may be eliminated and lobes of a crankshaft may be coupled to a four port, three way solenoid driving two distinct intake or exhaust valves. Two valve systems, each including a solenoid and a pump unit may be used to drive four intake valves or exhaust valves.

In this way, by using a single valve system to drive two input or exhaust valves coupled to separate cylinders, the number of components and the cost associated with the engine assembly may be reduced. By using fewer number of components, packaging of components within the engine block may be improved. The technical effect of using a camless system for driving intake and exhaust valves is that the cost of the engine assembly may decrease and engine start may be improved. Also, by eliminating cam drive and camshafts, it may be possible to adjust valve lift to zero and deactivate an engine cylinder during deceleration without the need for any additional hardware for both intake valves and exhaust valves.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
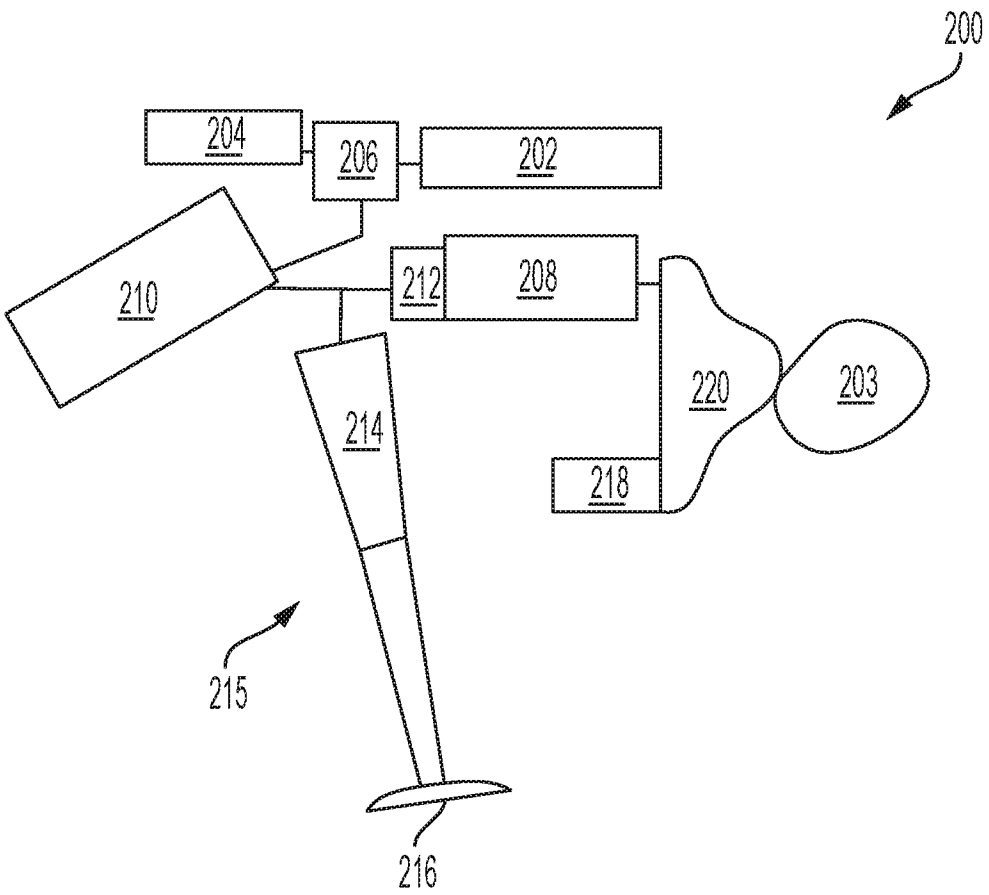
FIG. 2 schematically shows components of a solenoid and pump unit coupled to a single cylinder valve.
Figure 3:
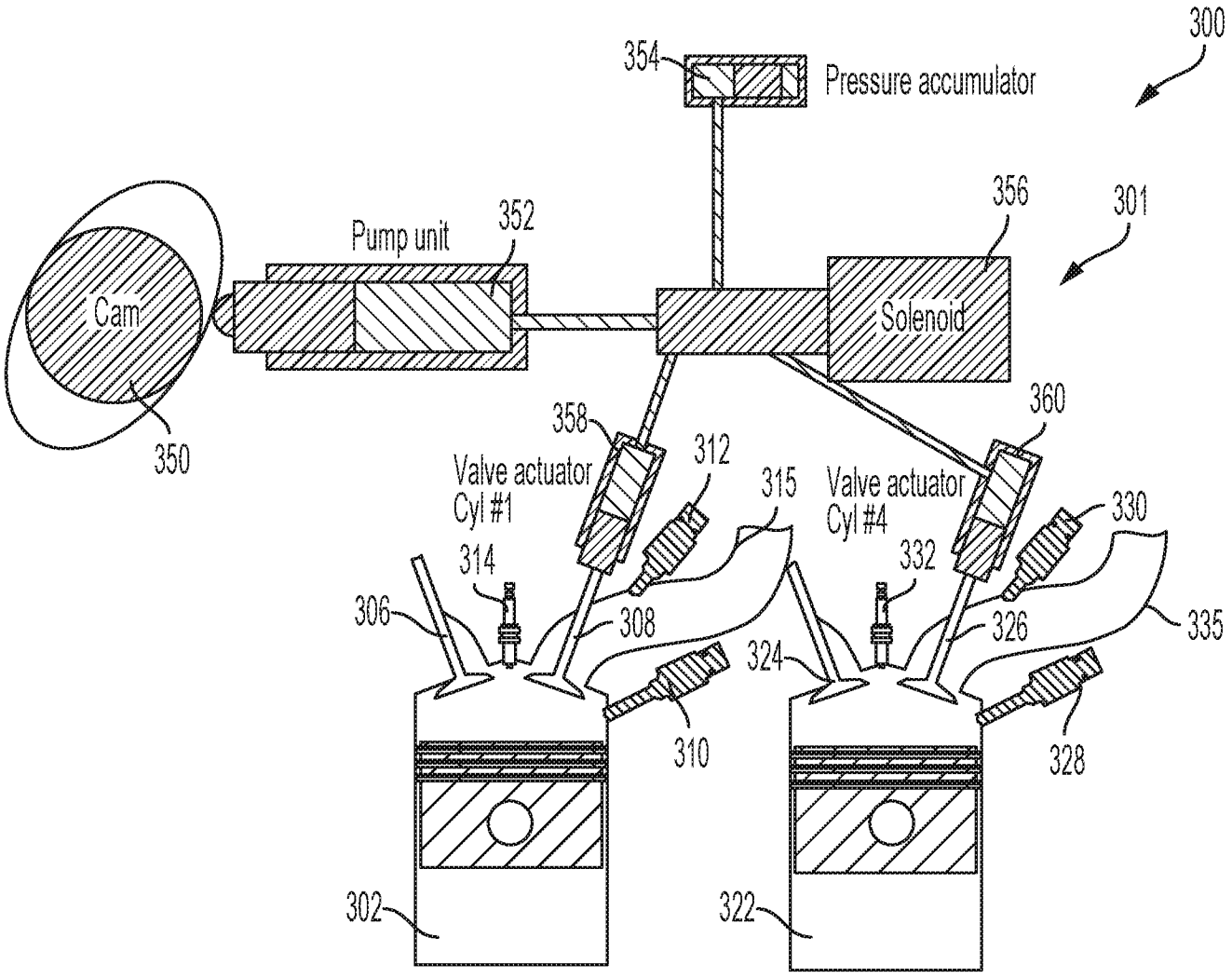
FIG. 3 schematically shows components of a valve system coupled to two separate valves.
Figure 4:
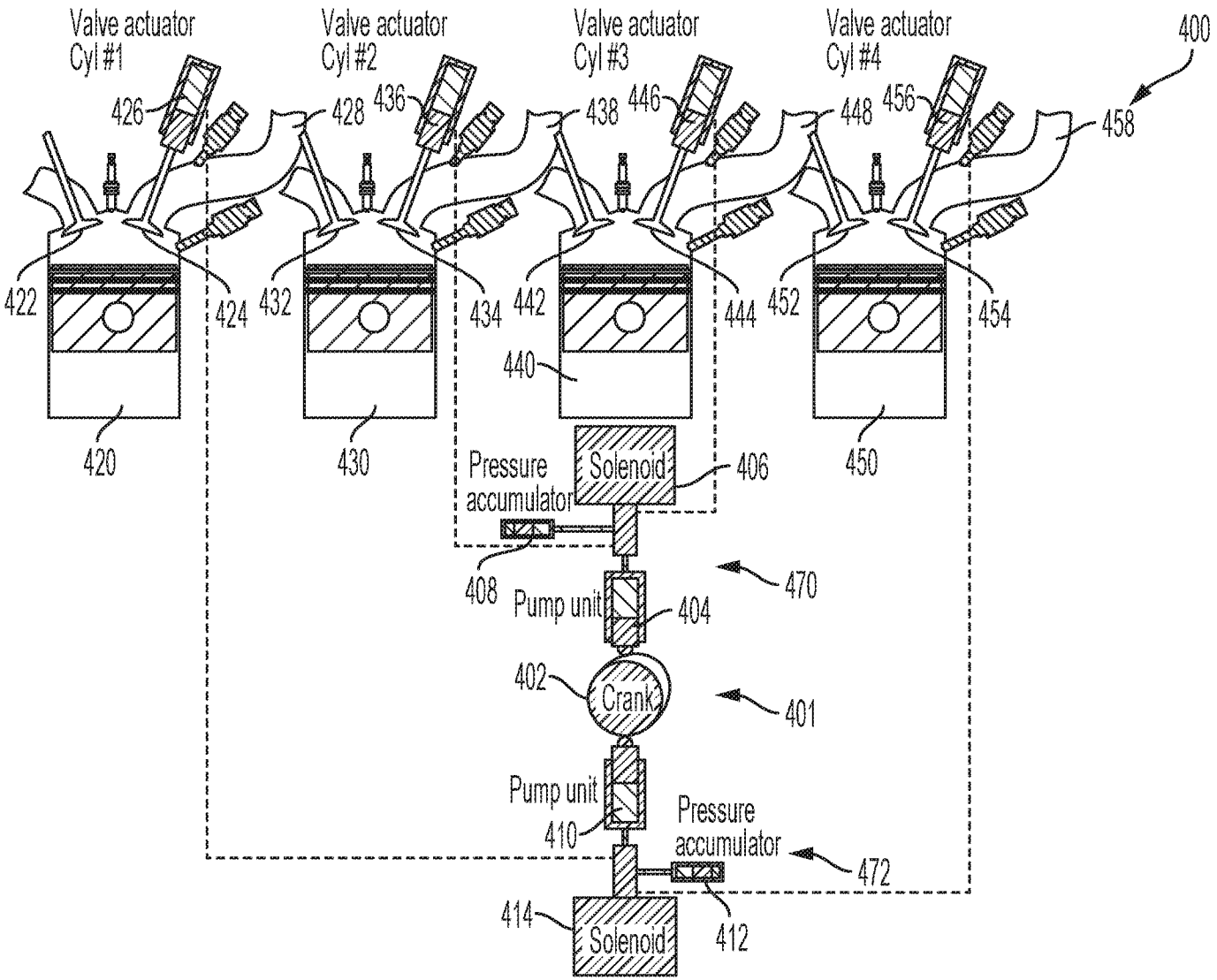
FIG. 4 shows components of a camless cylinder valve system.
Figure 6:
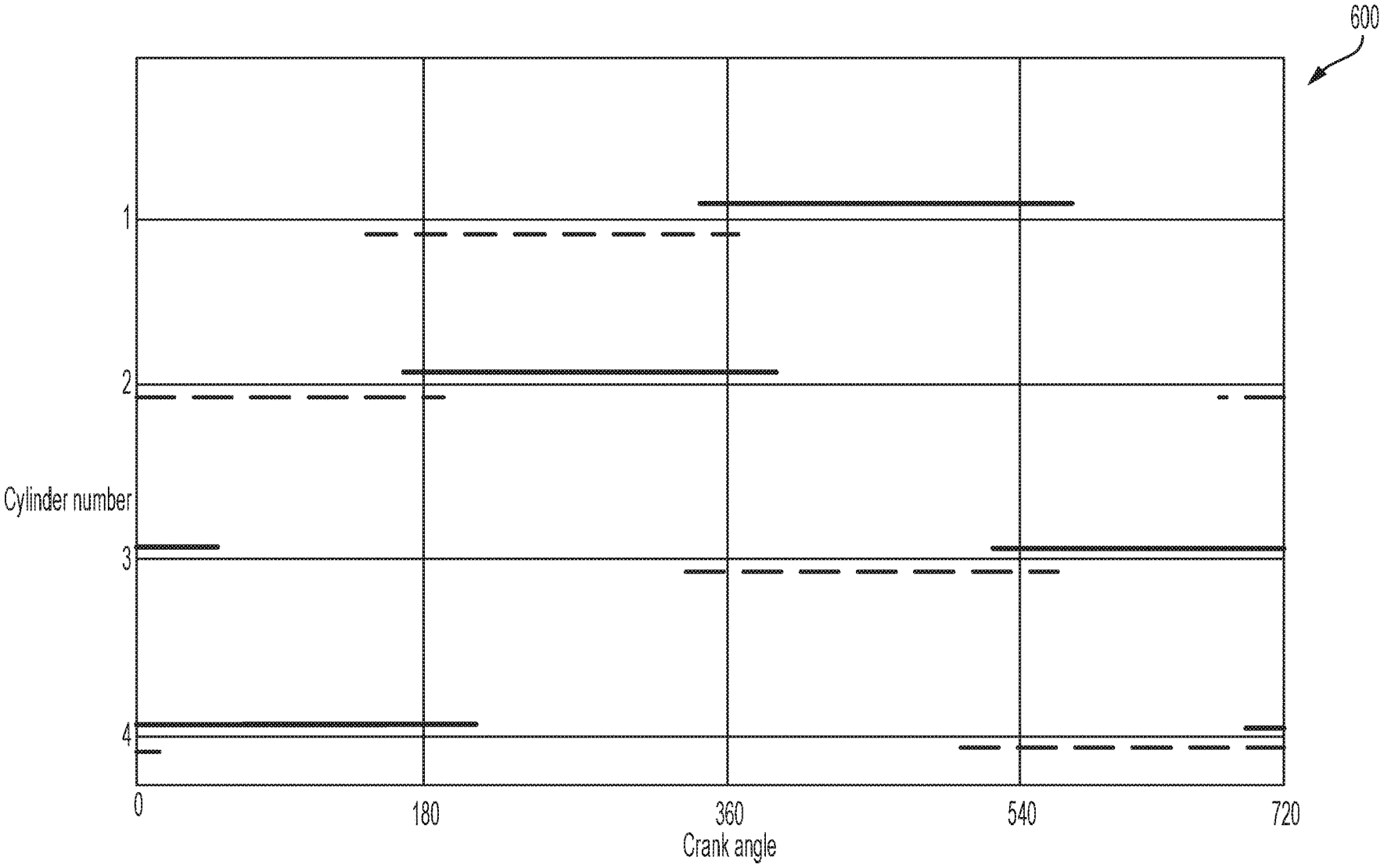
FIG. 6 shows valve timing in the inline four cylinder engine system.
Figure 7:
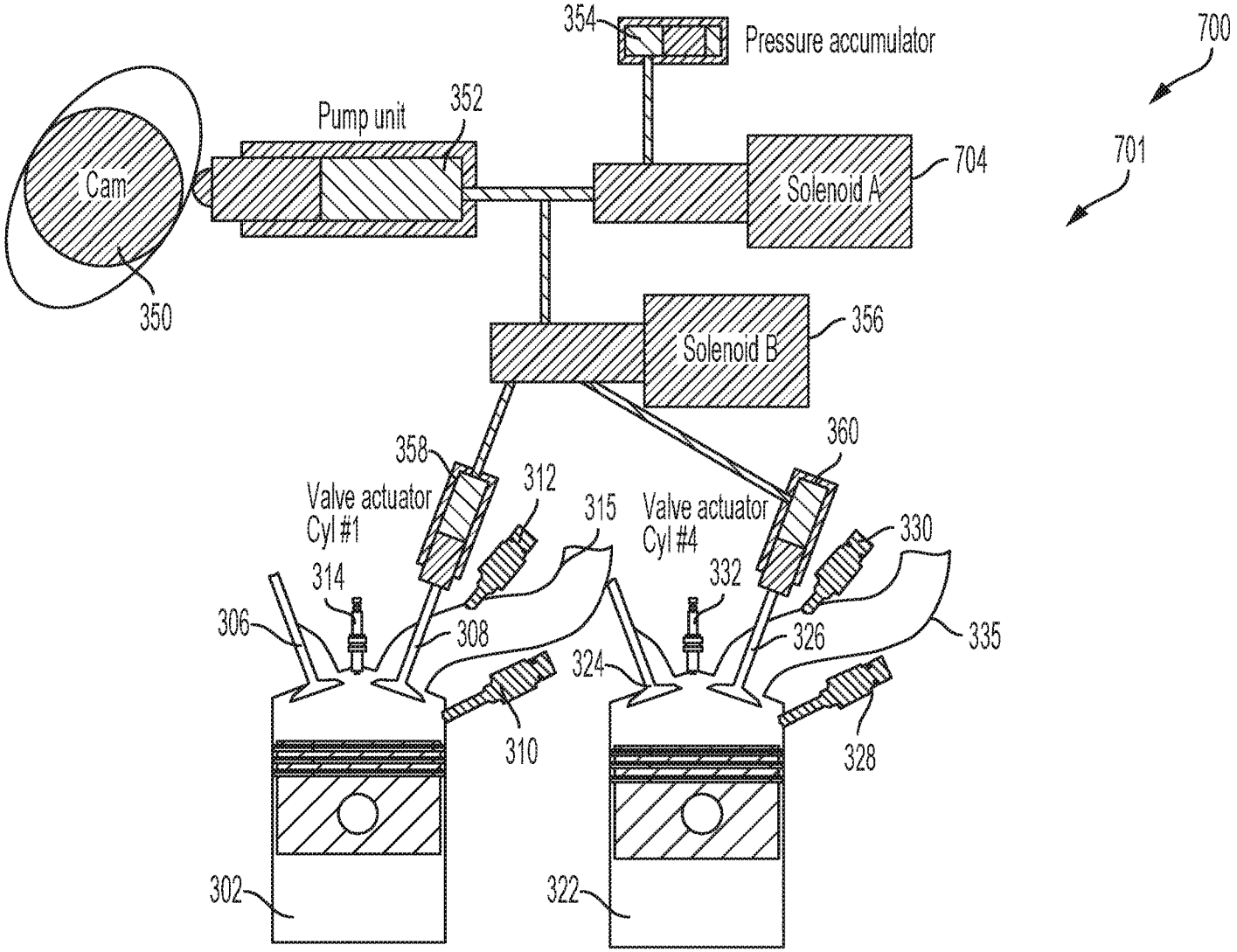
FIG. 7 schematically shows components of an alternate valve system coupled to two separate valves.

The following description relates to systems and methods for a continuously variable valve lift (cVVL) system. The cVVL system may be coupled to engine cylinders, such as the example cylinder shown in FIG. 1, in an inline four cylinder (I4) engine. As shown in FIGS. 3 and 7, a single valve system may be coupled to two valves on two different cylinders. The single valve system is depicted in FIG. 2. In an alternate embodiment, a camless valve system, as shown in FIG. 4, may be coupled to the engine cylinders. An engine controller may be configured to perform an example routine, such as according to the method described in FIG. 5 to operate the intake and exhaust valves of the I4 engine. An example valve timing for the engine cylinder intake and exhaust valves are shown in FIG. 6.

Figure 1:
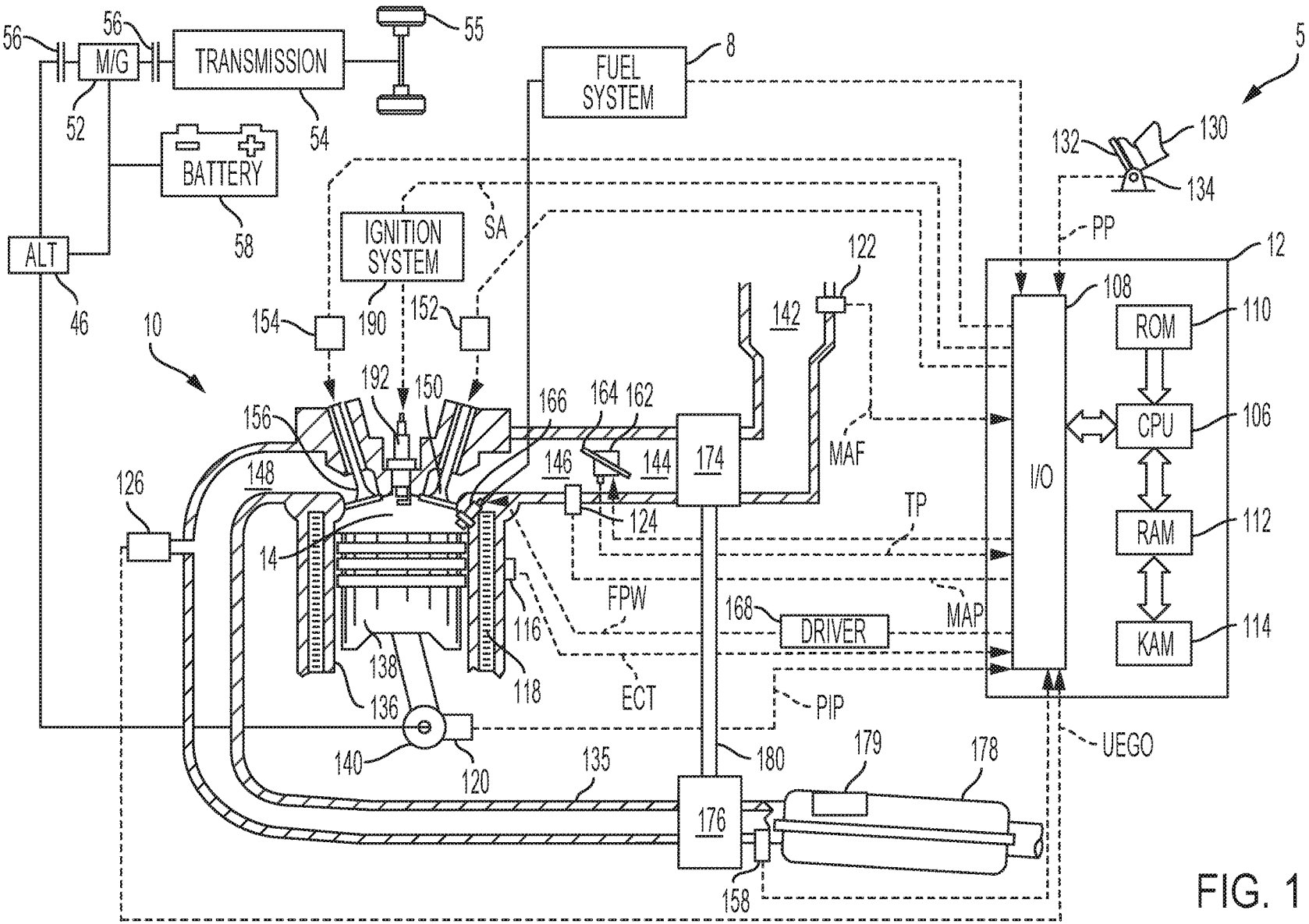
FIG. 1 schematically shows an example cylinder in an inline engine system.

FIG. 1 depicts an example of a cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as further described below. Further, a starter motor (not shown) may be coupled to crankshaft 140 via a flywheel to enable a starting operation of engine 10.

In some examples, the vehicle 5 may comprise an autonomous vehicle and/or a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, electric heater coupled to an electrically heated catalyst (EHC), vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via a series of intake passages 142 and 144 and an intake manifold 146. Intake manifold 146 may communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted. In still other examples, engine 10 may be provided with an electric supercharger (e.g., an "eBooster"), and compressor 174 may be driven by an electric motor.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

An exhaust manifold 148 can receive exhaust gases from other cylinders of engine 10 in addition to cylinder 14. An exhaust gas sensor 126 is shown coupled to exhaust manifold 148 upstream of an emission control device 178. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO. Emission control device 178 may be a three-way catalyst, a NOx trap, various other emission control devices, or combinations thereof. In the example of FIG. 1, emission control device 178 is an electrically heated catalyst (EHC). An electric heater (herein also referred to as a heating element) 179 may be coupled to the EHC 178 to electrically heat the catalyst during cold-start conditions. By actively heating the EHC 178, catalyst light-off may be expedited, thereby improving emissions quality during cold-start conditions.

An exhaust gas recirculation (EGR) delivery passage may be coupled to the exhaust passage upstream of turbine 176 to provide high pressure EGR (HP-EGR) to the engine intake manifold, downstream of compressor 174. An EGR valve may be coupled to the EGR passage at the junction of the EGR passage and the intake passage. EGR valve may be opened to admit a controlled amount of exhaust to the compressor outlet for desirable combustion and emissions control performance. EGR valve may be configured as a continuously variable valve or as an on/off valve. In further embodiments, the engine system may include a low pressure EGR (LP-EGR) flow path wherein exhaust gas is drawn from downstream of turbine 176 and recirculated to the engine intake manifold, upstream of compressor 174.

Each cylinder of engine 10 may include one or more intake valves and one or more exhaust valves. For example, cylinder 14 is shown including at least one intake valve 150 and at least one exhaust valve 156 located at an upper region of cylinder 14. In some examples, each cylinder of engine 10, including cylinder 14, may include at least two intake valves and at least two exhaust valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a hydraulic type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

In one example, valve lift for each of the intake valve 150 and the exhaust valve 156 may be continuously variable based on engine conditions such as in a continuous variable valve lift (cVVL) system. Based on valve timing, the intake valve 150 and the exhaust valve 156 may be opened via a valve system including a solenoid and a pump unit. An example valve system used for valve operation is elaborated with relation to FIG. 2. The intake or exhaust valves of two cylinders without overlapping valve timing may be operated via a single valve system including a pump and a single solenoid valve, thereby decreasing the number of components (such as pumps, solenoids, etc.) used for valve operation by half. The solenoid valve includes four ports, a first port coupled to the pump, a second port coupled to a pressure accumulator, a third port and a fourth port coupled to the hydraulic valve actuators of each of the two cylinder valves. The two cylinder valves may include a first intake valve coupled to a first cylinder and a fourth intake valve coupled to a fourth cylinder. An example of a valve system including a single pump unit operating two cylinder valves is elaborated with reference to FIG. 3. In one example, a camless engine valve actuation system, as elaborated with reference to FIG. 4, may include a crankshaft driving a valve system actuating two cylinder valves coupled to two separate cylinders, the valve system including a pump, a pressure accumulator, and a solenoid valve.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 135; a profile ignition pickup signal (PIP) from a Hall effect sensor 120 (or other type) coupled to crankshaft 140; throttle position (TP) from a throttle position sensor; signal UEGO from exhaust gas sensor 126, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of emission control device 178 based on the signal received from temperature sensor 158.

Controller 12 receives signals from the various sensors of FIG. 1 and employs the various actuators of FIG. 1 to adjust engine operation based on the received signals and instructions stored on a memory of the controller. For example, the controller may operate a single pump coupled to two engine valves based on valve timing and a position of the valve to open or close the respective valve.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

FIG. 2 shows a schematic of components of a solenoid and pump unit 200 (also referred herein as valve system) coupled to a single cylinder valve. The valve system 200 may include a pressure accumulator 202 coupled to a middle pressure chamber 206 via a spring loaded coupling. Engine oil may be supplied to the middle pressure chamber 206 via a conduit 204. The middle pressure chamber may be coupled to a solenoid valve 210. A roller finger follower 220 may be in contact with a camshaft 203, the roller finger follower 220 further coupled to a pump 208 via another spring loaded coupling, Each of the solenoid valve 210 and the pump 208 may be coupled to a high pressure chamber 212. The high pressure chamber 212 and the solenoid valve 210 may be coupled to a valve unit 215. The valve unit 215 may include a brake unit with a piston and a hydraulic lash adjuster 214 (also referred herein as the hydraulic valve actuator) on the upper portion (closer to the solenoid valve 210) and a valve 216 on the lower portion (distal to the solenoid valve 210). The valve 216 may be an intake valve housed in the intake port of a cylinder or an exhaust valve housed in the exhaust port of the cylinder.

The movement of the valve 216 may follow a profile on the camshaft 203. The camshaft 203 may drive the roller finger follower 220 causing oil pressure to be generated in the high pressure chamber 212. Oil may be pumped to the high pressure chamber via the pump 208. Upon closing of the solenoid valve 210, the oil pressure may act on the valve 216 by way of a piston, and the valve opens. As soon as oil flows through the open hydraulic valve out of the high-pressure chamber 212, the force level acting on the valve 216 against the valve spring assembly drops, and the valve 216 closes. When the solenoid valve 210 opens at cam lift, the oil flows out of the high-pressure chamber 212 into the middle pressure chamber 206. The solenoid valve 210 of FIG. 2 may be an on-off valve. When the solenoid 210 is closed, oil from the pump 208 may be transferred to the high pressure chamber 212 and when the solenoid is open, oil from the pump 208 may be transferred to the accumulator 202 and the corresponding valve 215 may close. In this way, a distinct pressure accumulator, a solenoid valve, and a pump may be used to operate a valve unit.

FIG. 3 shows a schematic 300 of components of a single valve system 301 coupled to two separate valves of two separate engine cylinders. A camshaft 350 may be coupled to a pump unit 352 which in turn may be coupled to a solenoid valve 356. In one example the camshaft 350 may be the camshaft 203 in FIG. 2 and the solenoid valve may be the solenoid valve 210 in FIG. 2. The solenoid valve 210 of FIG. 2 may be a coupled to each of a pressure accumulator via a middle pressure chamber, a pump via a high pressure chamber, and a single valve unit while the solenoid valve 356 of FIG. 3 may be a four port solenoid valve.

The four port solenoid valve 356 may be coupled to each of the pump unit 352 via a first port and to a pressure accumulator 354 via a second port. A third port and a fourth port of the solenoid valve 356 may be coupled to a first valve unit 358 and a second valve unit 360, respectively. Each of the valve units 358 and 360 may be the valve unit 215 of FIG. 2. The first valve unit 358 may include a hydraulic valve actuator and a first intake valve 308 coupled to a first cylinder and the second valve unit 360 may include a hydraulic valve actuator and a second intake valve 326 coupled to a second cylinder. Each of the first cylinder and the second cylinder may include intake ports 315 and 335 and exhaust ports. A first exhaust valve 306 may be coupled to the first cylinder 302 and a second exhaust valve 324 may be coupled to the second cylinder 322. Fuel may be supplied to each of the first cylinder 302 and the second cylinder 322 via port fuel injectors 312 and 330, respectively and/or via direct fuel injectors 310 and 328 respectively. Spark may be imparted to each of the first cylinder 302 and the second cylinder 322 via spark plugs 314 and 322, respectively.

The valve timing for the intake valves of the first cylinder and the second cylinder may not overlap. Hence a single pump unit, camshaft, pressure accumulator, and solenoid valve (together referred herein as valve system 301) may be used to operate each of the first valve unit 358 and the second valve unit 360 without interference. In one example, in an inline four cylinder engine, intake valves of the first cylinder and the fourth cylinder may not overlap and a single valve system may be used to drive the intake valves of the first cylinder and the fourth cylinder (depicted here as cylinders 302 and 322). An intake valve and an exhaust valve of two different cylinders may also be operated via a single valve system. In another example, in an inline four cylinder engine, the intake valve of the first cylinder and the exhaust valve of the second cylinder may not overlap and a single valve system may be used to drive the intake valve of the first cylinder and the exhaust valve of the second cylinder. In this way, in a four cylinder system four separate valve systems may be used to operate all the intake and exhaust valves, thereby reducing the number of engine components and the cost associated with engine assembly.

An alternate embodiment 700 of a single valve system 701 coupled to two separate valves of two separate engine cylinders is shown in FIG. 7. Components already introduced in FIG. 3 are numbered similarly and not reintroduced. In the valve system 701, the pressure accumulator 354 and the pump unit 352 may be coupled to two separate solenoids, a first solenoid 704 and a second solenoid 356. By activating the first solenoid 704, valves from a single cylinder (such as first cylinder 302 or second cylinder 322) may be connected to the pump unit 352 and the second solenoid 356 for actuation. In this way, a separate solenoid (such as first solenoid 704) may be used to select a valve (corresponding to a cylinder) which is to be opened or closed. FIG. 4 shows a schematic 400 of components of a camless engine cylinder valve actuation system 401. The engine system may include four cylinders 420, 430, 440, and 450 each with a separate intake and exhaust valve units. Each of the intake valve units 426, 436, 446, and 456 may be the valve unit 215 in FIG. 2. Each of the four cylinders 420, 430, 440, and 450 may be coupled to an intake port, an exhaust port, a port fuel injector, a direct fuel injector, and a spark plug.

The first valve unit 426 may include a hydraulic valve actuator and a first intake valve 424 coupled to the intake port 428 of the first cylinder 420, the second valve unit 436 may include a hydraulic valve actuator and a second intake valve 434 coupled to the intake port 438 of the second cylinder 430, the third valve unit 446 may include a hydraulic valve actuator and a third intake valve 444 coupled to the intake port 448 of the third cylinder 440, and the fourth valve unit 456 may include a hydraulic valve actuator and a fourth intake valve 424 coupled to the intake port 458 of the fourth cylinder 450.

In the camless valve actuation system, a crankshaft 402 may be used to drive the cylinder valves. A first subsystem 470 may include a first pump unit 404 directly coupled to the crankshaft at one end and a first solenoid valve 406 at the other end, and a first pressure accumulator 408 coupled to the first solenoid 406. The first subsystem 470 may be coupled to the second intake valve unit 436 and the third intake valve unit 446 and each of the second intake valve unit 436 and the third intake valve unit 446 may be sequentially operated via the single pump unit, solenoid valve, and pressure accumulator of the first subsystem 470. A second subsystem 472 may include a second pump unit 410 directly coupled to the crankshaft at one end and a second solenoid valve 414 at the other end, and a second pressure accumulator 412 coupled to the second solenoid 414. The second subsystem 470 may be coupled to the first intake valve unit 426 and the fourth intake valve unit 456 and each of the first intake valve unit 426 and the fourth intake valve unit 456 may be sequentially operated via the single pump unit, solenoid valve, and pressure accumulator of the second subsystem 472. In this way, instead of four, two pump units and solenoid valves may be used to drive four intake valves in a camless valve actuation system. Also, elimination of components such as camshafts, cam drives, cam sensors, etc. may reduce engine costs and packaging concerns.

In this example, a camless valve actuation system is shown for the intake valves of a four cylinder engine. A similar camless valve actuation system may also be used for the exhaust valves of the engine cylinders. Two additional subsystems each with a separate pump, a solenoid valve, and a pressure accumulator may be used to drive four exhaust valves.

By eliminating the camshaft, the modulus of compression of engine oil may be increased. In one example, the pump units in the camless valve actuation system may be located in the cylinder head and driven with a mechanical rod, thereby shortening the oil circuits. In another example, the hydraulic valve actuators including the brake units for each valve unit may be located in the engine block and may be coupled to the valves via push rods and rocker arms. In yet another example, a separate hydraulic fluid may be used for the valve train instead of engine oil. By using a separate fluid, cleanliness, low aeration, and optimal viscosity of the fluid may be maintained (not dependent on operator changing engine oil).

By eliminating cam sensors from the valvetrain, engine controls may no longer be synced with the cam position. Engine start times may be improved since a cylinder moving downward may be used for an intake stroke and fueled (or any upward moving cylinder may be used for compressions stroke and fueled via direct injection). In this way, without a cam sensor, the control system may determine the engine stroke based on a position of the piston (without coordination with a camshaft). By eliminating cam actuated cylinder valves, cylinder deactivation by deactivation of cylinder valves may be carried out during lower engine load conditions, thereby improving fuel efficiency.

Figure 5:
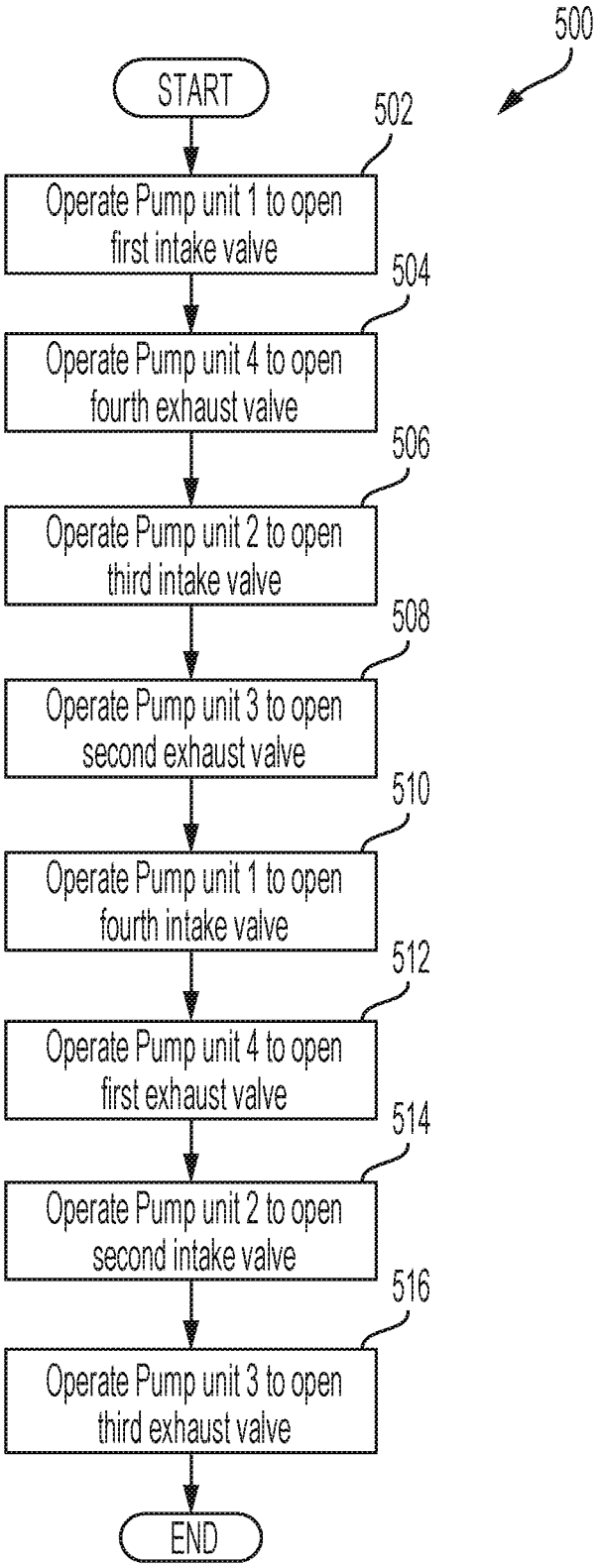
FIG. 5 shows a flowchart for an example method for operating intake and exhaust valves in engine cylinders.

FIG. 5 shows an example method 500 for opening intake and exhaust valves in a four cylinder inline (I4) engine. Instructions for carrying out method 500 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 502, a first valve system (valve system 1) may be used to open a first intake valve. Valve system 1 may include each component previously mentioned for valve system 301. A single pump and solenoid of valve system 1 may be used to drive the intake valves of a first cylinder and a fourth cylinder in the I4 engine.

At 504, a fourth valve system (valve system 4) may be used to open a fourth exhaust valve. Valve system 4 may also include each component previously mentioned for valve system 301. A single pump and solenoid of valve system 4 may be used to drive the exhaust valves of a first cylinder and a fourth cylinder in the I4 engine.

At 506, a second valve system (valve system 2) may be used to open a third intake valve. Valve system 2 may also include each component previously mentioned for valve system 301. A single pump and solenoid of valve system 2 may be used to drive the intake valves of a second cylinder and a third cylinder in the I4 engine.

At 508, a third valve system (valve system 3) may be used to open a second exhaust valve. Valve system 3 may also include each component previously mentioned for valve system 301. A single pump and solenoid of valve system 3 may be used to drive the exhaust valves of a second cylinder and a third cylinder in the I4 engine.

At 510, the valve system 1 may be used to open a fourth intake valve. Since the first intake valve may be closed prior to opening of the fourth intake valve, valve system 1 may be effectively used to non-concurrently operate two intake valves. At 512, the valve system 4 may be used to open a first exhaust valve. Since the fourth exhaust valve may be closed prior to opening of the first exhaust valve, valve system may be effectively used to non-concurrently operate two exhaust valves. At 514, the valve system 2 may be used to non-concurrently open a second intake valve. Since the third intake valve may be closed prior to opening of the second intake valve, valve system 1 may be effectively used to operate two intake valves. At 516, the valve system 3 may be used to open a third exhaust valve. Since the second exhaust valve may be closed prior to opening of the third exhaust valve, valve system 3 may be effectively used to operate two intake valves. In this way, four valve systems may be used to operate eight engine valves, thereby decreasing the number of components desired for engine valve operations.

In this way, a first valve system may be operated to open a first valve coupled to a first cylinder, close the first valve, then open a second valve coupled to a second cylinder and close the second valve, the valve system comprising a pump, a solenoid valve, and a pressure accumulator.

FIG. 6 shows an example 600 valve timing in the inline four cylinder engine system. The x-axis shows crank angle (in degrees) and the y-axis shows the cylinder number. The intake valves of each cylinder are depicted by solid lines while the exhaust valves of each cylinder are denoted by dashed lines.

The intake valve of the first cylinder is held open between the 360° and the 540° crank angle interval. The exhaust valve of the first cylinder is held open between the 180° and the 360° crank angle interval. The intake valve of the second cylinder is held open between the 180° and the 360° crank angle interval. The exhaust valve of the second cylinder is held open between the 0° and the 180° crank angle interval. The intake valve of the third cylinder is held open between the 540° and the 720° crank angle interval. The exhaust valve of the third cylinder is held open between the 360° and the 540° crank angle interval. The intake valve of the fourth cylinder is held open between the 0° and the 180° crank angle interval. The exhaust valve of the fourth cylinder is held open between the 540° and the 720° crank angle interval.

From the valve timing diagram for each of the valves it is observed that the intake valve of the first cylinder does not overlap with each of the intake valve of the fourth cylinder and the exhaust valve of the second cylinder. Hence a single valve system (such as valve system 301 in FIG. 3) may be used to drive the intake valve of the first cylinder along with either the intake valve of the fourth cylinder or the exhaust valve of the second cylinder without any interference. The intake valve of the second cylinder does not overlap with each of the intake valve of the third cylinder and the exhaust valve of the fourth cylinder. Hence a single valve system may be used to drive the intake valve of the second cylinder along with either the intake valve of the third cylinder or the exhaust valve of the fourth cylinder without any interference. The exhaust valve of the first cylinder does not overlap with each of the exhaust valve of the fourth cylinder and the intake valve of the third cylinder. Hence a single valve system may be used to drive the exhaust valve of the first cylinder along with either the exhaust valve of the fourth cylinder or the intake valve of the third cylinder without any interference. The exhaust valve of the second cylinder does not overlap with each of the exhaust valve of the third cylinder and the intake valve of the first cylinder. Hence a single valve system may be used to drive the exhaust valve of the second cylinder along with either the exhaust valve of the third cylinder or the intake valve of the first cylinder without any interference.

In this way, by reducing the number of components in a cylinder valve actuation system, packaging of the engine components may be improved, and component and manufacturing costs may be decreased.

In one example, a system for an engine, comprises: a valve system including a pump and a solenoid valve for non-concurrent actuation of two cylinder valves coupled to two separate cylinders. In the preceding example, additionally or optionally, the engine includes four cylinders in an in-line formation and wherein each of the two cylinder valves include a hydraulic valve actuator coupled to the solenoid valve. In any or all of the preceding examples, additionally or optionally, the two cylinder valves are intake valves or exhaust valves, valve timings of the two cylinder valves not overlapping. In any or all of the preceding examples, additionally or optionally, the two cylinder valves include a first intake valve coupled to a first cylinder and a fourth intake valve coupled to a fourth cylinder. In any or all of the preceding examples, additionally or optionally, the two cylinder valves include a second intake valve coupled to a second cylinder and a third intake valve coupled to a third cylinder. In any or all of the preceding examples, additionally or optionally, the two cylinder valves include the first intake valve coupled to the first cylinder and a second exhaust valve coupled to the second cylinder. In any or all of the preceding examples, additionally or optionally, the two cylinder valves include a first exhaust valve coupled to the first cylinder and a fourth exhaust valve coupled to the fourth cylinder. In any or all of the preceding examples, additionally or optionally, the two cylinder valves include the second exhaust valve coupled to the second cylinder and a third exhaust valve coupled to the third cylinder. In any or all of the preceding examples, further comprising, additionally or optionally, a camshaft driving a roller finger follower coupled to the pump. In any or all of the preceding examples, additionally or optionally, the solenoid valve includes four ports, a first port coupled to the pump, a second port coupled to a pressure accumulator, a third port and a fourth port coupled to hydraulic valve actuators of each of the two cylinder valves. In any or all of the preceding examples, further comprising, additionally or optionally, another solenoid coupled to the pressure accumulator and the solenoid, the solenoid activated to selectively actuate one of the two cylinder valves. In any or all of the preceding examples, additionally or optionally, the engine includes four distinct valve systems for actuation of eight cylinder valves and wherein the valve system is a continuously variable valve lift system.

Another example method for an engine comprises: operating a first valve system to open a first valve coupled to a first cylinder, close the first valve, then open a second valve coupled to a second cylinder and close the second valve, the valve system comprising a pump, a solenoid valve, and a pressure accumulator. In the preceding example, additionally or optionally, the pump is actuated via a camshaft driving a roller finger follower coupled to the pump and wherein the engine may include four cylinders arranged in a line. In the preceding example, additionally or optionally, the first cylinder is in a first position within the line and the second cylinder in a fourth position within the line and each of the first valve and the second valve are intake valves coupled to intake ports of the first cylinder and the second cylinder, respectively. In any or all of the preceding examples, additionally or optionally, the first cylinder is in a second position within the line and the second cylinder in a third position within the line. In any or all of the preceding examples, additionally or optionally, each of the first valve and the second valve are exhaust valves coupled to intake ports of the first cylinder and the second cylinder, respectively and wherein the solenoid is coupled to each of the first valve, the second valve, the pump, and a pressure accumulator.

In yet another example, camless engine valve actuation system, comprises: a crankshaft driving a valve system actuating two cylinder valves coupled to two separate cylinders, the valve system including a pump, a pressure accumulator, and a solenoid valve. In the preceding example, additionally or optionally, the pump is directly coupled to and actuated by the crankshaft. In any or all of the preceding examples, additionally or optionally, the two cylinder valves include a first intake valve coupled to a first cylinder and a fourth intake valve coupled to a fourth cylinder in an inline four cylinder (I4) engine.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for an engine, comprising:

a single valve system including a pump and a single solenoid valve that carry out non-concurrent actuation of two cylinder valves coupled to two separate cylinders without a camshaft and camshaft cams, wherein the engine is an inline four cylinder (I4) engine, wherein the two separate cylinders are a first cylinder and a fourth cylinder of the I4 engine, and wherein a second cylinder and a third cylinder are positioned between the first cylinder and the fourth cylinder of the I4 engine.

2. The system of claim 1, wherein each of the two cylinder valves include a hydraulic valve actuator coupled to the single solenoid valve.

3. The system of claim 1, wherein the two cylinder valves are intake valves or exhaust valves.

4. The system of claim 1, wherein the two cylinder valves include a first intake valve coupled to the first cylinder and a fourth intake valve coupled to the fourth cylinder.

5. The system of claim 4, further comprising a further single valve system that carries out non-concurrent actuation of two further cylinder valves, wherein the two further cylinder valves include a second intake valve coupled to the second cylinder and a third intake valve coupled to the third cylinder.

6. The system of claim 1, wherein the two cylinder valves include a first exhaust valve coupled to the first cylinder and a fourth exhaust valve coupled to the fourth cylinder.

7. The system of claim 1, further comprising a further single valve system that carried out non-concurrent actuation of two further cylinder valves, wherein the two further cylinder valves include a second exhaust valve coupled to the second cylinder and a third exhaust valve coupled to the third cylinder.

8. The system of claim 1, wherein the pump is directly coupled to and actuated by a crankshaft.

9. The system of claim 8, wherein, via a control system of the engine, an engine stroke is determined based on a position of a piston of the engine without coordination with a camshaft and without a cam sensor.

10. The system of claim 1, wherein the engine includes four distinct valve systems for actuation of eight cylinder valves, wherein the single valve system is one of the four distinct valve systems, and wherein the single valve system is a continuously variable valve lift system.

11. A method for an engine, comprises:

operating a valve system to actuate a first cylinder valve of a first cylinder and a fourth cylinder valve of a fourth cylinder without a camshaft and camshaft cams, wherein the actuation of the first cylinder valve and the fourth cylinder valve includes opening the first cylinder valve coupled to the first cylinder, closing the first cylinder valve, then opening the fourth cylinder valve coupled to the fourth cylinder that is separate from the first cylinder, and closing the fourth cylinder valve, the valve system comprising a pump, a single solenoid valve, and a pressure accumulator to carry out the actuation of the first cylinder valve and the fourth cylinder valve, wherein the engine is an inline four cylinder (I4) engine, and wherein a second cylinder and a third cylinder are both positioned between the first cylinder and the fourth cylinder of the I4 engine.

12. The method of claim 11, wherein, via a control system of the engine, an engine stroke is determined based on a position of a piston of the engine without coordination with a camshaft and without a cam sensor.

13. The method of claim 12, wherein each of the first cylinder valve and the fourth cylinder valve are intake valves coupled to intake ports of the first cylinder and the fourth cylinder, respectively.

14. The method of claim 11, wherein each of the first cylinder valve and the fourth cylinder valve are exhaust valves coupled to the first cylinder and the fourth cylinder, respectively, and wherein the single solenoid valve is coupled to each of the first cylinder valve, the fourth cylinder valve, the pump, and a pressure accumulator.

15. An engine valve actuation system, comprising:

a crankshaft driving a valve system actuating two cylinder valves without a camshaft and camshaft cams, where each of the two cylinder valves are coupled to a different cylinder of two separate cylinders, where the valve system comprises a first subsystem to actuate the two cylinder valves that includes a pump, a pressure accumulator, and a single solenoid valve, wherein the two cylinder valves include a first intake valve coupled to a first cylinder and a fourth intake valve coupled to a fourth cylinder in an inline four cylinder (I4) engine, and wherein a second cylinder and a third cylinder are positioned between the first cylinder and the fourth cylinder in the I4 engine.

16. The system of claim 15, further comprising:

two further cylinder valves, a first of the two further cylinder valves coupled to the second cylinder and a second of the two further cylinder valves coupled to the third cylinder, wherein the valve system comprises a second subsystem to actuate the two further cylinder valves that includes a further pump, a further pressure accumulator, and a further single solenoid valve, and wherein the pump and the further pump are directly coupled to and actuated by the crankshaft.

* * * * *